US007531491B2

(12) United States Patent
Min et al.

(10) Patent No.: US 7,531,491 B2
(45) Date of Patent: May 12, 2009

(54) AQUEOUS CLEANING SOLUTION FOR INTEGRATED CIRCUIT DEVICE AND METHOD OF CLEANING USING THE CLEANING SOLUTION

(75) Inventors: Chang-Sup Min, Incheong-si (KR); Sang-Jun Choi, Seoul (KR); Chang-Ki Hong, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 554 days.

(21) Appl. No.: 10/982,406

(22) Filed: Nov. 5, 2004

(65) Prior Publication Data

US 2005/0159322 A1 Jul. 21, 2005

(30) Foreign Application Priority Data

Nov. 7, 2003 (KR) ..... 10-2003-0078640

(51) Int. Cl.
*C11D 7/50* (2006.01)

(52) U.S. Cl. ..... 510/175; 510/176; 510/201

(58) Field of Classification Search ..... 510/175, 510/176, 201

See application file for complete search history.

(56) References Cited

U.S. PATENT DOCUMENTS 5,258,062 A * 11/1993 Nakazawa et al. ..... 106/1.23
5,308,401 A 5/1994 Geke et al. ..... 134/2
5,366,650 A * 11/1994 Wiesenfeld et al. ..... 252/70
5,413,731 A * 5/1995 Adler et al. ..... 510/230
5,643,409 A * 7/1997 Hamaguchi et al. ..... 162/5
5,932,021 A * 8/1999 Cala et al. ..... 134/2
5,935,488 A * 8/1999 Wiesenfeld et al. ..... 252/70
6,277,799 B1 * 8/2001 Sachdev et al. ..... 510/176
6,440,633 B1 * 8/2002 Kawauchi ..... 430/270.1
6,653,273 B2 * 11/2003 Ruggiero et al. ..... 510/421
6,916,772 B2 * 7/2005 Zhou et al. ..... 510/201

FOREIGN PATENT DOCUMENTS

JP 04-124688 4/1992
JP 04124668 A * 4/1992
KR 10-2003-0019145 A 3/2003

OTHER PUBLICATIONS

Patent Abstracts of Japan for Publication No. 04-124688.
Korean Patent Abstracts for Publication No. 1020020019145A.

* cited by examiner

*Primary Examiner*—Gregory E Webb
(74) *Attorney, Agent, or Firm*—F. Chau & Associates, LLC

(57) ABSTRACT

Aqueous cleaning solutions are provided for cleaning an integrated circuit device formed on a wafer, as well as methods of cleaning a wafer using the aqueous cleaning solution. In one aspect, an aqueous cleaning solution includes a low foam surfactant, a metal corrosion inhibitor, an acidic pH control agent or an alkali pH control agent, and water.

10 Claims, 1 Drawing Sheet

AQUEOUS CLEANING SOLUTION FOR INTEGRATED CIRCUIT DEVICE AND METHOD OF CLEANING USING THE CLEANING SOLUTION

CROSS-REFERENCE TO RELATED APPLICATION

This application claims priority to Korean Patent Application No. 2003-78640, filed on Nov. 7, 2003, which is incorporated herein by reference in its entirety.

BACKGROUND OF THE INVENTION

1. Field of the Invention

The present invention relates, generally, to an aqueous cleaning solution for cleaning an integrated circuit device and a method of cleaning using the same, and more particularly, to an aqueous cleaning solution for cleaning an integrated circuit device on which a metal and polysilicon are simultaneously exposed, and a method of cleaning using the same.

2. Description of the Related Art

Generally, in a semiconductor manufacturing process, the throughput of integrated circuits is largely affected by unwanted physical and chemical contaminants. Such contaminants also affect the reliability and performance of the integrated circuits. As a design rule of an integrated circuit decreases, the cleaning and detecting of smaller size contaminants on a wafer in a semiconductor manufacturing process has become increasingly more important.

Since the development of the RCA cleaning technique in the 1960s, SC-1 (Standard Cleaning 1, $NH_4OH/H_2O_2/H_2O$) has been widely used for its superior particle removing capability. In a process for removing organic material, SPM (Sulfuric Peroxide Mixture, $H_2SO_4/H_2O_2$) has been widely used. In the SC-1 and SPM cleaning solutions, hydrogen peroxide acts as a strong oxidant. For example, by reacting with the hydrogen peroxide, an organic substance on a surface of a wafer dissolves and oxidizes. In addition, hydrogen peroxide may corrode a metal on the surface of the wafer due to the metal reacting with oxygen of the hydrogen peroxide. Further, polysilicon formed on the surface of the wafer oxides so as to form a natural silicon oxide layer. Then, the silicon oxide layer is removed together with particles on the surface of the wafer.

However, resistance of a wiring formation of the integrated circuits must be reduced as a result of the reduction of the design rule. Therefore, in order to reduce the resistance of the wiring formation, a metal, e.g., tungsten, is introduced in an early stage of forming the integrated circuit, such as a gate line fabrication stage. As a result, because the hydrogen peroxide ($H_2O_2$) component of the cleaning solutions can corrode a metal that forms a gate line, the SC-1 or SPM cleaning solution cannot be used as a cleaning solution in the process of forming the gate line. Also, the gate line is partially exposed in a subsequent process. Thus, using the SC-1 or SPM cleaning solution can corrode the gate line in the subsequent process.

To solve these problems, an aqueous cleaning solution that contains a metal corrosion inhibitor is used. A conventional aqueous cleaning solution that contains a metal corrosion inhibitor, such as aliphatic alcohol with an element of a mercapto group bound thereto, that is, 2-mercaptoethanol or thioglycerol, is disclosed in U.S. Pat. No. 6,200,947. This conventional aqueous cleaning solution is a pro-environmental cleaning solution containing a metal corrosion inhibitor and has a superior capability for removing particles, ashing residues, and/or polymers. Also, the conventional aqueous cleaning solution protects a metal such as tungsten from corrosion because it contains a metal corrosion inhibitor. However, the conventional aqueous cleaning solution has a high etching characteristic toward polysilicon. Therefore, when cleaning a wafer with exposed polysilicon using the conventional aqueous cleaning solution, undercutting of the polysilicon or Si pitting can occur.

Another conventional aqueous cleaning solution that is widely used for cleaning a metal includes a cationic surfactant or a nonionic surfactant. When the conventional aqueous cleaning solution that contains one of these surfactants is used, the cleaning ability is improved due to the superior foaming characteristics of the cleaning solution. However, such an aqueous solution generates a lot of foam during a cleaning process. As a result, excessive generation of foam can cause an overflow of the cleaning solution in a cleaning bath, which can deteriorate a uniformity of a cleaning effect on a wafer because some of the foam can adhered to the surface of the wafer. This incomplete cleaning can cause a defect on the integrated circuit substrate.

Meanwhile, another conventional aqueous cleaning solution that can be used for cleaning a wafer on which both a metal and polysilicon are exposed is disclosed in Korea Laid-Open Patent Application No. 2002-0005388. The aqueous cleaning solution contains a silicon corrosion inhibitor that prevents corrosion of polysilicon, and is represented by the following formulas 1 or 2:

$$HO\text{-}\{(EO)_x\text{-}(PO)_y\}_z\text{—}H \quad \text{[Formula 1]}$$

$$R\text{-}[\{(EO)_x\text{-}(PO)_y\}_z\text{—}H]_m \quad \text{[Formula 2]}$$

where EO is an oxyethylene radical; PO is an oxypropylene radical; and R is a remainder of an alcohol or amine without a hydrogen atom of a hydroxide radical of the alcohol or amine or a remainder of amino acid without a hydrogen atom of the amino acid.

The aqueous cleaning solution containing a non-ion surfactant represented by the above formulas 1 and 2 can prevent polysilicon from being etched. Also, the above compounds have a low defoaming rate because the compounds have a high foaming characteristic. Therefore, when the aqueous cleaning solution is used for cleaning a wafer, there is a high possibility of an overflow of the aqueous cleaning solution. Moreover, the generated foam can adhere to the surface of the wafer resulting in the wafer having a non-uniform clean surface, which can further cause defects on the surface of the wafer.

SUMMARY OF THE INVENTION

In general, exemplary embodiments of the present invention include aqueous cleaning solutions that are suitable for cleaning an integrated circuit device on which both a metal and polysilicon are exposed while preventing overflow of the aqueous cleaning solution during a cleaning process and obtaining a uniformly clean surface on the wafer after the cleaning process is complete.

Furthermore, exemplary embodiments of the present invention include methods of cleaning an integrated circuit device on which both a metal and polysilicon are exposed, preventing overflow of the aqueous cleaning solution from a surface of a wafer during a cleaning process, and providing a uniformly clean surface of the wafer after a cleaning process is completed are provided.

According to one exemplary embodiment of the present invention, an aqueous cleaning solution for cleaning an integrated circuit device comprises a low foaming surfactant, a metal corrosion inhibitor, a pH control agent, and water.

According to another exemplary embodiment, the pH control agent is an acidic pH control agent or an alkali pH control agent.

According to another exemplary embodiment, a surfactant promotes a surface reaction, thereby improving a cleaning ability of the aqueous cleaning solution and protecting polysilicon from an aqueous cleaning solution for cleaning metal.

According to another exemplary embodiment, the aqueous cleaning solution includes a low foaming surfactant. The low foaming surfactant is a modified form of nonionic surfactant that comprises an aliphatic alcohol added to ethylene oxide and a terminal hydroxyl radical that is capped by an alkyl radical.

According to another exemplary embodiment, the aqueous cleaning solution for cleaning an integrated circuit device further comprises a metal corrosion inhibitor that prevents corrosion of an exposed metal during a cleaning process. Therefore, the aqueous cleaning solution is suitable for cleaning an integrated circuit device in which both a metal and polysilicon are exposed. The aqueous cleaning solution is especially suitable for cleaning a metal such as tungsten used to form a gate electrode to reduce a resistance of an integrated circuit device, or to form a metal contact in an early stage of fabricating a semiconductor device. Accordingly, the metal corrosion inhibitor of the aqueous cleaning solution can be a material that prevents corrosion of a metal, e.g., tungsten or copper, used for forming a wiring formation of a semiconductor device or a barrier metal, e.g., titanium or titanium nitride.

According to another exemplary embodiment, the aqueous cleaning solution includes a low foaming surfactant. The low foaming surfactant is a modified form of a nonionic surfactant, wherein the low foaming surfactant comprises an aliphatic alcohol added to ethylene oxide and a terminal hydroxyl radical of which is capped by an alkyl radical.

According to another exemplary embodiment, the aqueous cleaning solution for cleaning an integrated circuit device further comprises a metal corrosion inhibitor that prevents corrosion of an exposed metal during a cleaning process. Therefore, the aqueous cleaning solution is suitable for cleaning an integrated circuit device in which both a metal and polysilicon are exposed. The aqueous cleaning solution is especially suitable for cleaning a metal such as tungsten used to form a gate electrode to reduce a resistance of an integrated circuit device, or to form a metal contact in an early stage of fabricating a semiconductor device. Accordingly, the metal corrosion inhibitor can be a material that prevents corrosion of a metal for wiring such as tungsten or copper and a barrier metal such as titanium or titanium nitride by the aqueous cleaning solution.

According to another exemplary embodiment, the aqueous cleaning solution for cleaning an integrated circuit device further includes a compound for controlling a pH of the aqueous cleaning solution such as an alkali pH control agent or an acidic pH control agent. The aqueous cleaning solution can be acidified or basified. Preferably, the aqueous cleaning solution includes an alkali pH control agent that basifies.

These and other exemplary embodiments, features, aspects, and advantages of the present invention will be described and become apparent from the following detailed description of the exemplary embodiments when read in conjunction with the accompanying drawings.

BRIEF DESCRIPTION OF THE DRAWINGS

The FIGURE is a graph showing a comparison of defoaming rates of an aqueous cleaning solution which comprises a low foaming surfactant according to exemplary embodiments of the present invention and an aqueous cleaning solution which contains a conventional surfactant.

DETAILED DESCRIPTION OF EXEMPLARY EMBODIMENTS

Figure 1:
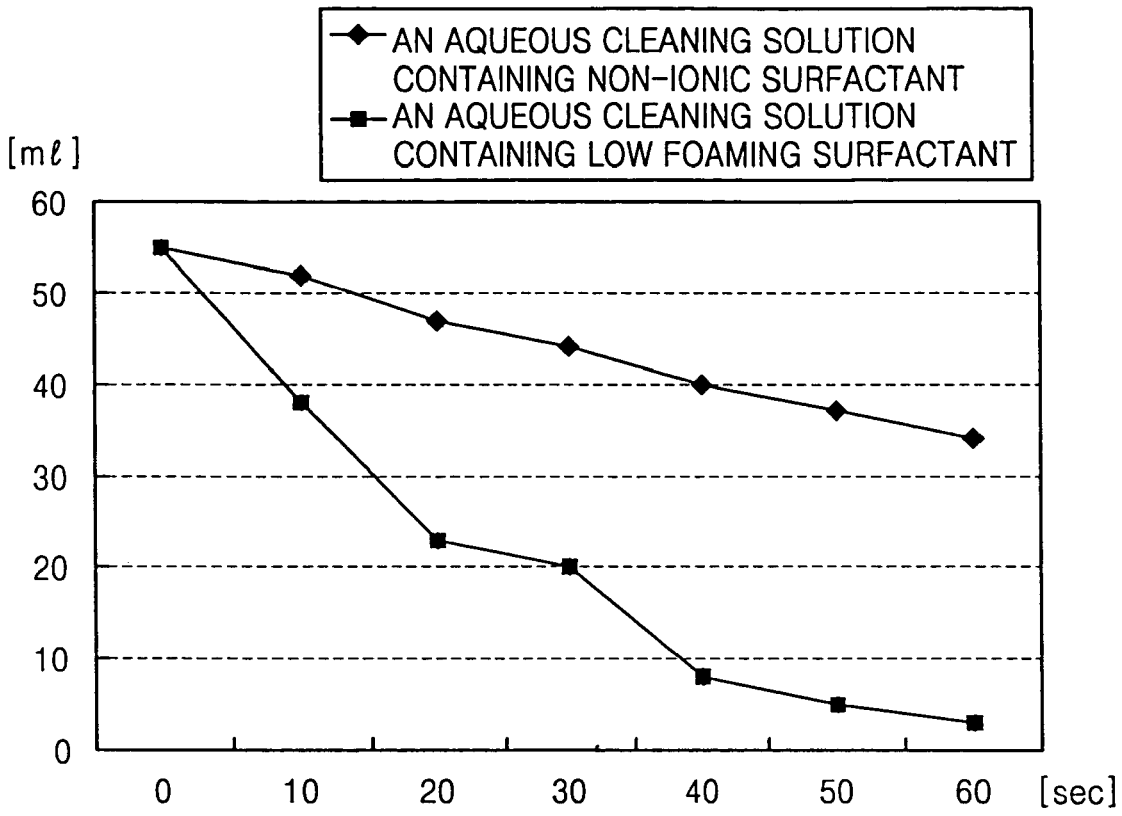

The present invention will now be described more fully with reference the following exemplary embodiments of the present invention are shown. This invention may, however, be embodied in many different forms and should not be construed as being limited to the exemplary embodiments set forth herein. Rather, these exemplary embodiments are provided so that this disclosure will be thorough and complete, and will fully convey the concept of the invention to those skilled in the art.

A low foaming surfactant contained in an aqueous cleaning solution according to an exemplary embodiment is represented by the following formula 3:

$$R_1—O(CH_2CH_2O)_m—X \quad \text{[Formula 3]}$$

where R1 is a hydrophobic alkyl group such as methyl, butyl, iso-butyl, iso-octyl, nonyl phenyl, octyl phenyl, decyl, tridecyl, lauryl, myristyl, cetyl, stearyl, oleyl, linoleyl or behnyl, m is a number ranging from 0 to 50, and X is a hydrophobic and short alkyl group such as ethyl, propyl, iso-propyl, butyl, or iso-butyl.

An aqueous cleaning solution comprising a low foaming agent has a faster defoaming rate than an aqueous cleaning solution that contains a cationic surfactant or a nonionic surfactant. Because of the faster defoaming rate, the aqueous cleaning solution comprising the low foaming agent prevents the overflow of the aqueous cleaning solution and the foam from adhering to the surface of the wafer being cleaned.

The low foaming surfactant exhibits a different solubility in an aqueous cleaning solution and a different capability of surface activating capability at an interface between the polysilicon and the aqueous cleaning solution according to the compounds R1 and X and the value of m. That is, the rate of foaming and defoaming can be controlled by selecting R1, X, and m appropriately.

A concentration of the low foaming surfactant is preferably from about 0.0001 to about 10 wt %, and more preferably from about 0.001 to about 1 wt %. When the concentration of the low foaming surfactant is too low, the foaming ability of the cleaning solution could be significantly decreased resulting in a decrease in the surfactants ability to protect polysilicon. When the concentration of the low foaming surfactant increases, the foaming ability and polysilicon protection ability of the cleaning solution also increase. However, when the concentration of the low forming surfactant reaches a certain level, the polysilicon protection ability of the cleaning solution is neither increased nor decreased. The concentration of the low foaming surfactant, at this stage, can be varied in accordance with R1, X, the value of m and/or the pH of the aqueous cleaning solution.

A metal corrosion inhibitor included in the aqueous cleaning solution for cleaning an integrated circuit according to an exemplary embodiment of the present invention prevents corrosion of metals such as tungsten, copper, titanium, and titanium nitride, and their alloys by the aqueous cleaning solution. The metal corrosion inhibitor can be a compound having a triple bond and including more than one hydroxyl group that can be represented by the following formula 4:

$$R_2(Z)\text{-}C{\equiv}C\text{-}(Z)\text{-}R_3 \quad \text{[Formula 4]}$$

where Z is a straight or branched hydrocarbon group having 1~10 carbon atoms, and R2 and R3 are independently methyl (CH3), methoxy (OCH3), a halide (X), amino (NH2), nitro (NO2), thio (SH), hydroxy(OH), an aldehyde (CHO) or a carboxylic acid (COOH).

In formula 4, the triple bond prevents corrosion of a metal, and materials constituting R2 and R3 control solubility of the anticorrosive agent in the aqueous cleaning solution and control a surface activating capability at the interface between the surface of the metal and/or polysilicon and the aqueous cleaning solution. An example of compound represented by formula 4 is 2-butyne-1, 4-diol or 3-butyne-1-ol.

The metal corrosion inhibitor can be a thiol compound. Examples of the thiol compounds are 2-mercaptoethanol or 1-mercapto-2,3-propandiol.

Both metal corrosion inhibitors, that is, thiol compounds and compounds represented by formula 4, have shown favorable characteristics on metal surfaces. Both materials exhibit excellent metal protection characteristics. However, a compound represented by formula 4 exhibits a superior ability to protect polysilicon over the thiol compounds because the compound represented by formula 4 has lower etching rate for polysilicon than the thiol compounds.

The concentration of the metal corrosion inhibitor in an aqueous cleaning solution is preferably from about 0.0001 to about 10 wt %, and more preferably from about 0.001 to about 1 wt %. When the concentration of the metal corrosion inhibitor is low, metal corrosion caused by the aqueous cleaning solution increases. As the concentration of the metal corrosion inhibitor increases, metal corrosion caused by the cleaning solution decreases. However, when the concentration of the metal corrosion inhibitor reaches a certain level in the cleaning solution, the anticorrosion effect is not linearly increased but unchanged. The concentration of a metal corrosion inhibitor in the cleaning solution where the anticorrosion effect is unchanged varies according to the type of metal corrosion inhibitor and pH of the aqueous cleaning solution.

An aqueous cleaning solution which includes a low foaming surfactant and a metal corrosion inhibitor can be an acidic aqueous solution or a basic aqueous solution. That is, the aqueous cleaning solution can include an acidic pH control agent or an alkali pH control agent for controlling the pH of the aqueous cleaning solution and water. When the main purpose of the cleaning process is to remove particles, the aqueous cleaning solution preferably includes the alkali pH control agent. Examples of processes of which the main purpose is to remove particles are a process of etching tungsten for forming a conductive line such as a gate line or a bit line, or a chemical mechanical polishing (CMP) process for forming a contact or a conductive line by using a damascene process.

There is no specific guide line for selecting an alkali pH control agent. A compound including an inorganic basic salt or an organic basic salt can be used as the alkali pH control agent. Examples of the former are NaOH, KOH, and $NH_4OH$, and examples of the latter are tetra methyl ammonium hydroxide (TMAH) and chlorides. Amongst the above examples, TMAH is preferable for the alkali pH control agent.

The concentration of the basic pH control agent is preferably from about 0.0001 to about 10 wt %, and more preferably from about 0.01 to about 5 wt %. When a concentration of the basic pH control agent is too low, i.e., alkalinity of the solution is too low, cleaning ability decreases. On the other hand, when the concentration of the basic pH control agent is too high, i.e., an alkalinity of the solution is too high, the cleaning ability of the cleaning solution increases, but the aqueous cleaning solution can corrode a metal on a wafer surface, and moreover, it can corrode cleaning equipment.

EXPERIMENT

The purpose of the present experiment is to examine defoaming rates of an aqueous cleaning solution that includes a low foaming surfactant according to the exemplary embodiments of the present invention and an aqueous cleaning solution that contains a conventional nonionic surfactant. In this experiment, an ammonium hydroxide solution having a pH value at 10.5 was used for both of the aqueous cleaning solutions. A height of foam with respect to time was measured after adjusting an initial height of 55 ml. The nonionic surfactant is an iso-octyl alcohol ethylene oxide adduct that is represented by formula 5, and the low foaming surfactant according to the exemplary embodiments of the present invention is a low foaming iso-octyl alcohol ethylene oxide adduct, represented by formula 6. As seen in formula 6, the low foaming surfactant is a compound in which the hydroxyl radical of the nonionic surfactant is capped by a methyl radical.

$$C_8H_{17}\text{—}O(CH_2CH_2O)_8\text{—}H \quad \text{[Formula 5]}$$

$$C_8H_{17}\text{—}O(CH_2CH_2O)_8\text{—}CH_3 \quad \text{[Formula 6]}$$

FIG. 1 is a graph showing the defoaming rates of the experiment results. Referring to FIG. 1, the defoaming rate of the aqueous cleaning solution including the low foaming surfactant is 1.175 ml/sec, which is three times faster than that of the aqueous cleaning solution containing a conventional nonionic surfactant, which has a defoaming rate of 0.375 ml/sec.

An aqueous cleaning solution according to the exemplary embodiments of the present invention is effective for cleaning particles and/or contaminants from a wafer without damaging a pattern formed of a metal and polysilicon. Therefore, the aqueous cleaning solution according to the present invention is suitable for removing particles after forming a gate line formed of a metal such as tungsten.

Moreover, the aqueous cleaning solution according to the present invention is effective for protecting the polysilicon and/or integrated circuit substrate and the aqueous cleaning solution does not overflow in a bath since it includes a low foaming surfactant. Thus, non-uniformity of a cleaning process and defects due to the residual foam can be avoided because of the fast defoaming rate.

What is claimed is:

1. An aqueous cleaning solution for cleaning an integrated circuit device, comprising:

a low foaming surfactant;

a metal corrosion inhibitor;

a pH control agent; and water, and wherein the metal corrosion inhibitor is a compound represented by the following formula 8:

$$R_2(Z)\text{-}C{\equiv}C\text{-}(Z)\text{-}R_3 \quad \text{[Formula 8]}$$

wherein Z is a straight or a branched hydrocarbon group having 1~10 carbon atoms, R2 and R3 are independently methyl (CH3), methoxy (OCH3), a halide (X), amino (NH2), nitro (NO2), thio (SH), hydroxy (OH), an aldehyde (CHO) or a carboxylic acid (COOH) and wherein the low foaming surfactant is a compound represented by the following formula 7:

$$R_1—O(CH_2CH_2O)_m—X \quad \text{[Formula 7]}$$

wherein R1 is methyl, butyl, iso-butyl, iso-octyl, nonyl phenyl, octyl phenyl, decyl, tridecyl, lauryl, myristyl, cetyl, stearyl, oleyl, linoleyl or behnyl, m is a number ranging from 0 to 50, and X is methyl, ethyl, propyl, iso-propyl, butyl, or iso-butyl.

2. The aqueous cleaning solution of claim 1, wherein the concentration of the low foaming surfactant is from about 0.0001 to about 10 wt%.

3. The aqueous cleaning solution of claim 1, wherein the metal corrosion inhibitor represented by formula 8 is 2-butyne-1,4-diol or 3-butyne-1-ol.

4. The aqueous cleaning solution of claim 1, wherein the concentration of the metal corrosion inhibitor is from about 0.0001 to about 10 wt%.

5. The aqueous cleaning solution of claim 1, wherein the pH control agent is an alkali pH control agent, and wherein the alkali pH control agent is a compound selected from a group consisting of sodium hydroxide, potassium hydroxide, ammonium hydroxide, tetra methyl ammonium hydroxide and tetra methyl animonium hydroxide chloride.

6. The aqueous cleaning solution of claim 5, wherein the concentration of the alkali pH control agent is from about 0.0001 to about 10 wt%.

7. The aqueous cleaning solution of claim 1, wherein the pH control agent is an acidic pH control agent.

8. An aqueous cleaning solution for cleaning an integrated circuit device, comprising:

a low foaming surfactant;

a metal corrosion inhibitor, wherein the metal corrosion inhibitor is 2-mercaptoethanol or 1-mercapto-2, 3-propandiol;

a pH control agent; and water, and wherein the low foaming surfactant is a compound represented by the following formula 7:

$$R_1—O(CH_2CH_2O)_m—X \quad \text{[Formula 7]}$$

wherein R1 is methyl, butyl, iso-butyl, iso-octyl, nonyi phenyl, octyl phenyl, decyl, tridecyl, lauryl, myristyl, cetyl, stearyi, Olevi, linoleyl or behnyl, m is a number ranging from 0 to 50, and X is methyl, ethyl, propyl, iso-propyl, butyl, or iso-butyl.

9. The aqueous cleaning solution of claim 8, wherein the metal corrosion inhibitor is 1-mercapto-2, 3-propandiol.

10. The aqueous cleaning solution of claim 8, wherein the metal corrosion inhibitor is 2-mercaptoethanol.

* * * * *